US005201496A

United States Patent [19]

Bradette et al.

[11] Patent Number: 5,201,496

[45] Date of Patent: Apr. 13, 1993

[54] LINE RELEASING PULLEY SYSTEM

[75] Inventors: Jean-Marc Bradette, Embrun; Jeffrey E. Toycen, Ottawa, both of Canada

[73] Assignee: Her Majesty the Queen in right of Canada, as represented by the Solicitor General of Canada, Canada

[21] Appl. No.: 725,974

[22] Filed: Jul. 5, 1991

[30] Foreign Application Priority Data

Jul. 9, 1990 [CA] Canada ..... 2020774

[51] Int. Cl.[5] ..... B66D 3/04

[52] U.S. Cl. ..... 254/405

[58] Field of Search ..... 254/405, 402, 406, 407, 254/270; 212/116, 123; 294/82.33, 82.24, 82.12

[56] References Cited

U.S. PATENT DOCUMENTS

| | | | |
|---|---|---|---|
| 610,172 | 9/1898 | Dotson | 254/405 |
| 746,718 | 12/1903 | Loth | 254/406 |
| 796,366 | 8/1905 | Smith | 254/406 |
| 1,135,740 | 4/1915 | Thorp | 254/405 |
| 1,428,118 | 9/1922 | Robeson et al. | 254/405 |
| 2,235,302 | 3/1941 | Stillwagon | 254/405 |
| 2,474,433 | 6/1949 | McKissick | 254/406 |
| 2,527,350 | 10/1950 | Brown | 254/406 |
| 3,094,313 | 6/1963 | Filipozzi | 254/196 |
| 3,787,032 | 1/1974 | Bagby | 254/190 |

FOREIGN PATENT DOCUMENTS

| | | | |
|---|---|---|---|
| 0173022 | 11/1952 | Austria | 254/405 |
| 850943 | 7/1949 | Fed. Rep. of Germany . | |
| 603470 | 4/1926 | France . | |
| 247589 | 12/1947 | Switzerland . | |
| 254350 | 12/1948 | Switzerland . | |
| 281845 | 7/1952 | Switzerland . | |

*Primary Examiner*—Daniel P. Stodola
*Attorney, Agent, or Firm*—Ronald G. Bitner

[57] ABSTRACT

A line releasing pulley system suitable for the remote conveyance of an article, such as an improvised explosive device, along a complex path, involving many direction changes. The pulley system comprises a pulley frame having a pivoting cheek plate that provides automatic release of the line as a breaker member on the line passes over the pulley.

3 Claims, 1 Drawing Sheet

LINE RELEASING PULLEY SYSTEM

FIELD OF THE INVENTION

This invention relates to a line releasing pulley system, and particularly to a pulley system suitable for the remote conveyance of an article, such as an improvised explosive device, along a complex path.

BACKGROUND OF THE INVENTION

In the art of bomb disposal it is frequently desirable to remove an improvised explosive device, or suspected device, from a building, or critical structural supporting member of a building, aircraft, etc. One approach for the removal of such article involves the use of pulleys and ropes to convey the device remotely. However, the present hook and line system has a number of deficiencies. With the prior system each additional change of direction requires an additional line. The need to attach and manipulate a number of lines is not only difficult to achieve, but it also prolongs the exposure to danger for personnel.

It would be desirable if an improvised explosive device could be conveyed along a complex path with many direction changes with a single line.

U.S. Pat. No. 3,094,313 discloses a releasable load-suspension device that uses a releaser member on the line to disengage the device from its overhead support. However, since the line remains trained on the pulley and the entire device is released from its support, such device is not suitable for use in conveying explosive devices.

SUMMARY OF THE INVENTION

An object of the present invention is to provide a line releasing pulley system that allows the line to be released at predetermined points.

Another object is to provide a system for remotely conveying an article along a complex path, involving a number of direction changes, with the use of pulleys and a single line.

It has been found that articles can be conveyed along a complex path using a line releasing pulley, or pulleys, in combination with a single line having attached thereto a breaker member to effect automatic release of the line from a pulley where a change of direction is required.

The present invention provides a line releasing pulley system comprising: a pulley frame comprising a pair of cheek plates; a pulley rotatably supported by one of said cheek plates; pivot means pivotally connecting one of said cheek plates to said frame for pivoting about an axis perpendicular to the rotational axis of the pulley; retention means for releasably retaining the cheek plates in a closed position to confine line between the cheek plates; and cheek plate separating means comprising a breaker member attached to the line and breaker contacting portions disposed on said cheek plates, said breaker member and contact portions cooperating to separate the cheek plates as the breaker member on the line passes over the pulley.

DESCRIPTION OF THE PREFERRED EMBODIMENTS

Figure 1:
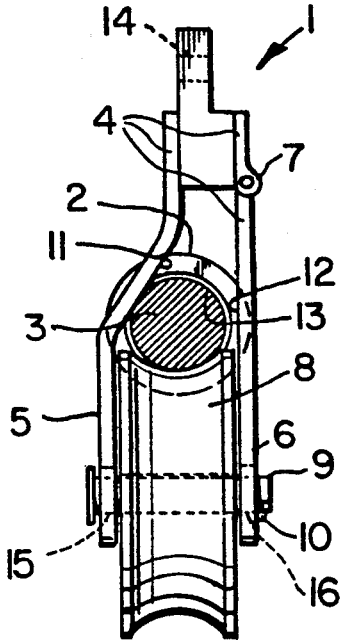
FIG. 1 illustrates one embodiment of a line releasing pulley system in accordance with the present invention.

With reference to FIG. 1, the line releasing pulley system of the present invention comprises a pulley assembly 1 and breaker member 2 adapted for securing on a line 3.

The pulley assembly 1 comprises a frame 4 comprising a pair of cheek plates 5 and 6, wherein one cheek plate 6 is pivotally connected to the frame 4 by means of a hinge 7. A pulley 8 is rotatably supported on cheek plate 5 by means of pin 9 cooperating with apertures 15 and 16 in cheek plates 5 and 6. The cheek plate 6 pivots about an axis perpendicular to the rotational axis of the pulley and is releasably held in a closed position by retention means shown in the form of a spring ball retainer 10.

Figure 2:
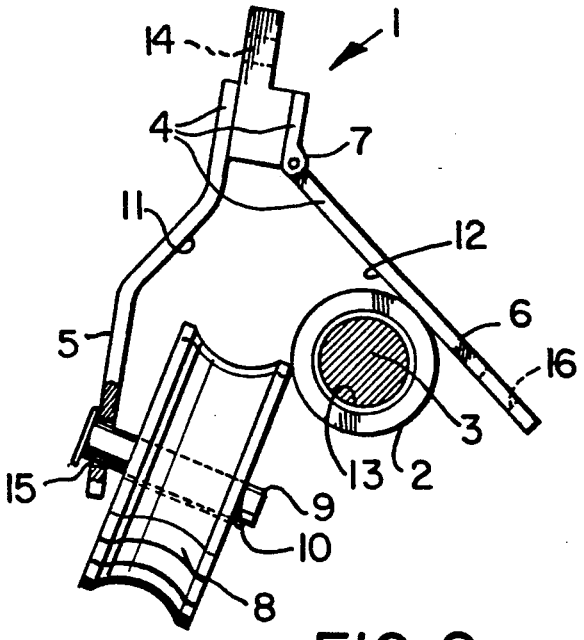
FIG. 2 shows the embodiment of FIG. 1 with the line being released.

The pulley 8 is shown attached to a pin 9 that is rotatably mounted and fitted loosely in aperture 15 of cheek plate 5 so that it will tilt downward to facilitate line release, as shown in FIG. 2.

The pulley assembly will preferably include some form of attachment means, shown as apertures 14, for attaching to a fixed object or structure.

Cooperating with the pulley assembly is a breaker member 2 secured to a line 3. The cheek plates 5 and 6 of the pulley assembly 1 define contacting portions 11 and 12 which are spaced apart a distance less than the largest diameter of the breaker member 2.

The breaker member 2 is shown to include a hollow generally frustoconical portion that defines an aperture 13 for receiving line 3. The breaker member 2 is retained on the line at the desired position by suitable means, for example, a knot in the line.

To facilitate placing the breaker member 2 at any point on the line, the breaker member may be provided with a longitudinal slot extending radially outward form the aperture 13. The slot will preferably have a width slightly smaller then the diameter of the aperture to allow the lien to be forced through and provide that the line is retained in the aperture 13.

FIG. 1 shows the breaker member 2 just before passing over the pulley 8.

In operation the breaker member 2, as it passes over the pulley 8, overcomes the force of the retension means 10 and spreads the cheek plates 5 and 6 to provide release of the line 3 from the pulley 8, as shown in FIG. 2. As can be seen in FIG. 2, the pulley is shown tilted downward due to the loosely fitting pin 9 in aperture 15.

The preferred use of the present invention is for the remote conveyance of an article, such as the removal of an improvised explosive device. For such use a pulley assembly would be located at each point where a change of direction is required. A change of direction might for example be required at a doorway in which case the pulley assembly might be attached to a bar temporarily mounted in the doorway. Alternatively, or additionally, a pulley assembly can be attached to a stand positioned on the floor, or onto any convenient available fixed object.

Figure 3:
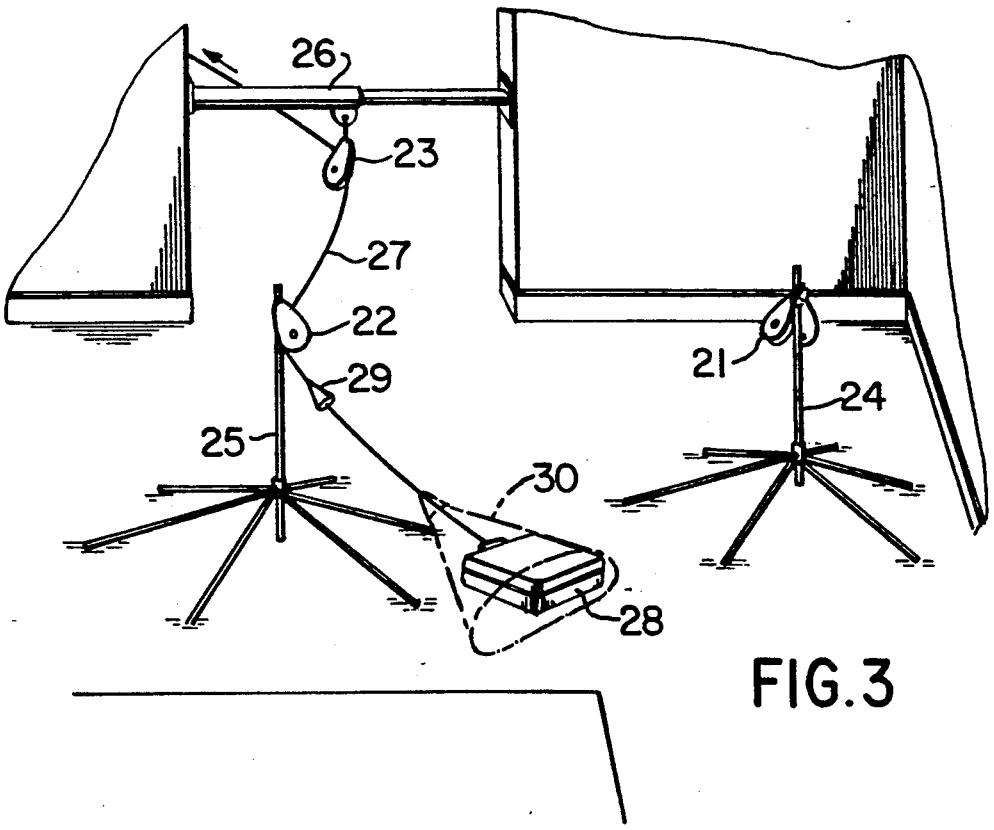
FIG. 3 shows a number of the line releasing pulleys of the present invention installed for the remote conveyance of an article.

An example of such an arrangement is shown in FIG. 3. Pulley assemblies, 21, 22 and 23, supported by support means 24, 25 and 26, respectively, are positioned along the desired travel path where a change of direction is required. Initially the line 27 for conveying the article 28 is positioned on each of the pulley assemblies 21, 22 and 23 along the intended travel path. The breaker member 29 is secured to the line 27 at a point near to the attachment point with the article 28 so that the lien is released from the pulley as it is approached by the pulley. As shown in FIG. 3 the line 27 has been released from pulley 21 and the article is being drawn towards pulley 22. After the breaker member 29 passes through pulley 22 the line will be released therefrom, and the direction of travel will be towards the next pulley 23 along the desired travel path.

The line 27 will preferably be made of a material having low elasticity to avoid oscillations upon release of the line.

As shown in FIG. 3, the article may be placed in a cone shaped covering 30 which reduces the possibility of the article becoming caught on objects along the desired conveyance path, and makes it possible to achieve direction changes greater than 90°.

As shown in FIGS. 1 and 2, the pulley 8 will preferably be fixed to pin 9, to avoid the pulley becoming a loose object that could otherwise become an additional projectile in the event of an explosion.

It will understood that the present invention may have uses other than that detailed above, for example, the conveyance of articles for marine, mountaineering, and other safety applications.

What is claimed is:

1. A line releasing pulley system comprising:

a pulley frame comprising a pair of cheek plates, each cheek plate having a pin receiving aperture disposed therein;

a pulley supporting pin cooperating with the pin receiving apertures of the cheek plates, the pin being rotatably mounted in one of the cheek plates and loosely fitted in the aperture, to allow tilting of the pin upon release of the other end of the pin from the other cheek plate, and wherein the tilting is sufficient to allow a line to be released from the pulley;

a pulley rotatably supported by said pulley supporting pin;

pivot means pivotally connecting one of said cheek plates of said frame for pivoting about an axis perpendicular to the rotational axis of the pulley;

retention means for releasably retaining the cheek plate in a closed position to confine a line between the cheek plates; and cheek plate separating means comprising a breaker member attached to the line and breaker contacting portions disposed on said cheek plates said breaker member and contacting portions cooperating to separate the cheek plates as the breaker member on the line passes over the pulley.

2. The system of claim 1 wherein the breaker member comprises a hollow generally frustoconical portion defining an aperture to receive the line and having an outer diameter larger than the spacing of the cheek plates in a closed condition.

3. A line releasing pulley system comprising a plurality of pulley assemblies, and a line;

each of said pulley assemblies comprising a pulley frame having a pair of cheek plates and each cheek plate having a pin receiving aperture disposed therein; a pulley supporting pin cooperating with the pin receiving apertures of the cheek plates, the pin being rotatably mounted in one of the cheek plates and loosely fitted in the aperture, to allow tilting of the pin upon release of the other end of the pin from the other cheek plate, and wherein the tilting is sufficient to allow the line to be released from the pulley; a pulley rotatably supported by said pulley supporting pin; pivot means pivotally connecting one of said cheek plates of said frame for pivoting about an axis perpendicular to the rotational axis of the pulley; retention means for releasably retaining the cheek plates in a closed position to confine the lien between the cheek plates; and cheek plate separating means comprising a breaker member attached to the line and breaker contacting portions disposed on the cheek plates of the pulley assemblies, said breaker member and contacting portions cooperating to separate the pair of cheek plates of one of the pulley assemblies as the breaker member on the line passes over the pulley of the corresponding pulley assembly.

* * * * *